US005865553A

United States Patent [19]

Flye Sainte Marie et al.

[11] Patent Number: 5,865,553

[45] Date of Patent: Feb. 2, 1999

[54] LIQUID-INK WRITING INSTRUMENT HAVING A RESERVOIR FITTED WITH A SYSTEM TO PREVENT LOSS OF PRIMING

[75] Inventors: Benoît Flye Sainte Marie, St Martin/Boulogne; José Duez, Boulognes/Mer; Serge Romy; Zoltan Trajber, both of Boulogne S/Mer; Philippe Lefebvre, Wimereux; Philippe Chavatte, Boulogne S/Mer, all of France

[73] Assignee: Conte S.A., Boulogne S/MER, France

[21] Appl. No.: 904,698

[22] Filed: Aug. 1, 1997

[30] Foreign Application Priority Data

Aug. 2, 1996 [FR] France ..... 96 09971

[51] Int. Cl.[6] ..... B43K 5/00

[52] U.S. Cl. ..... 401/199; 401/142

[58] Field of Search ..... 401/199, 198, 401/142, 141

[56] References Cited

U.S. PATENT DOCUMENTS

| | | | |
|---|---|---|---|
| 3,308,501 | 3/1967 | Marsh | 401/198 |
| 3,501,225 | 3/1970 | Martin et al. | 401/198 |
| 3,648,804 | 3/1972 | Kamp et al. | 401/199 X |
| 3,993,409 | 11/1976 | Hart | 401/199 |
| 4,764,045 | 8/1988 | Tschawow | 401/199 X |
| 4,889,442 | 12/1989 | Takagi et al. | 401/142 X |
| 5,033,896 | 7/1991 | Lytle et al. | 401/199 X |
| 5,131,776 | 7/1992 | Mott | 401/198 |
| 5,352,052 | 10/1994 | Kaufmann | 401/199 |
| 5,470,904 | 11/1995 | Loftin et al. | 401/198 X |

FOREIGN PATENT DOCUMENTS

| | | | |
|---|---|---|---|
| 0 516 538 A1 | 12/1992 | European Pat. Off. . | |
| 0 624 483 A1 | 11/1994 | European Pat. Off. . | |
| 2 629 015 | 9/1989 | France . | |
| 41 01 784 A | 7/1992 | Germany . | |
| 2142584 | 1/1985 | United Kingdom | 401/199 |
| WO 87/00404 | 1/1987 | WIPO . | |

*Primary Examiner*—David J. Walczak
*Assistant Examiner*—Kathleen J. Prunner
*Attorney, Agent, or Firm*—Wolf, Greenfield & Sacks, P.C.

[57] ABSTRACT

A writing instrument is provided, including a writing tip, a reservoir containing a liquid ink, and a capillary transfer rod extending from a first end to a second end of the reservoir. The capillary transfer rod transfers the liquid ink from the reservoir to the writing tip. A capillary element having an orifice is slidably mounted around the capillary transfer rod so as to move freely in the reservoir. An outside edge of the capillary element comes into the immediate vicinity of an inside wall of the reservoir in such a manner that the capillary element comes substantially flush with an inside wall of the reservoir as it slides along the transfer rod.

13 Claims, 2 Drawing Sheets

LIQUID-INK WRITING INSTRUMENT HAVING A RESERVOIR FITTED WITH A SYSTEM TO PREVENT LOSS OF PRIMING

The present invention relates to a liquid-ink writing instrument in which the ink is in the free state in a reservoir, not being held captive in a set of fibers constituting a fiber reservoir. In such a writing instrument, the ink is transferred from the reservoir to the writing tip by a rod referred to as the "transfer rod", the writing tip possibly being constituted by the end of said rod. The present invention relates more particularly to a writing instrument of the above-specified type which is fitted with a system to prevent loss of priming and which is also capable of acting as a gauge for indicating how much ink remains in the reservoir.

BACKGROUND OF THE INVENTION

A writing instrument making use of liquid ink contained in a reservoir and having a transfer rod is described, in particular, in document EP 0 516 538. The body of the instrument includes an internal partition which defines the reservoir for liquid ink in the rear portion of the body. The rear end of the transfer rod penetrates into the reservoir via said internal partition.

Such a writing instrument loses priming when the transfer rod is no longer fed with ink while the reservoir still contains liquid ink. This means that it ceases to write, which is naturally inconvenient for the user, particularly since the user may believe that the instrument needs to be discarded although it still contains usable ink.

On considering the description and the drawings illustrating embodiments of such a writing instrument in document EP 0 516 538, it will be understood that such loss of priming can occur when the instrument is used while its rod is not immersed in the ink, once a certain quantity of ink has already been used up. Given that the rear end of the transfer rod penetrates only a short way into the reservoir, the ink remaining in the bottom of the reservoir no longer reaches said rear end when the instrument has its tip pointing upwards. Once all the ink contained in the transfer rod has been used up, then priming is lost.

The same phenomenon can also be observed when writing with the tip pointing downwards, but with the instrument held at an angle and when only a small amount of ink remains in the reservoir.

OBJECT AND BRIEF SUMMARY OF THE INVENTION

The object of the Applicant is to provide a writing instrument in which liquid ink is contained in a reservoir and is transferred from the reservoir to the writing tip via a capillary transfer rod, while mitigating the above-specified drawbacks by being fitted with a system for preventing loss of priming.

According to the invention, the transfer rod extends over the full height of the reservoir to the far end thereof, and carries therearound a capillary element mounted to move freely in the reservoir, the orifice of the capillary element having dimensions slightly greater than those of the transfer rod and the outside edge of the capillary element coming into the immediate vicinity of the inside wall of the reservoir in such a manner that the capillary element, as it slides along the transfer rod, comes substantially flush with the inside wall of the reservoir.

The invention is based on the principle whereby the capillary element is moved along the transfer rod as a function of the position taken by the instrument. When the writing instrument is used in a horizontal or a sloping position, the inside edge of the orifice of the capillary element comes into contact with the outside face of the transfer rod. The ink contained in the capillary element can thus diffuse into the transfer rod to feed the writing tip. As the ink contained in the capillary element is used up by the transfer rod, the liquid ink, which is constantly in contact with the capillary element, diffuses via said element and continues to feed the transfer rod and thus the writing tip with ink.

Preferably, the orifice of the capillary element is about 0.2 mm to 0.8 mm greater in size than the transfer rod.

In a preferred embodiment, the transfer rod is circular in section having a diameter of about 3.5 mm, and the orifice of the capillary element has a diameter of about 4.5 mm.

Advantageously, the reservoir is cylindrical in shape, having an inside diameter of about 14 mm, and the capillary element is circular in shape, having an outside diameter of about 13 mm.

To prevent the capillary element jamming along the transfer rod while the instrument is in a sloping position, it is important for said capillary element to weigh enough, which means that its thickness should lie at least in the range 2 mm to 4 mm.

In order to improve sliding of the capillary element along the transfer rod, the inside edge of the capillary element around the orifice is rounded. Avoiding any sharp edges in the orifice zone of the capillary element avoids any risk of it jamming on the transfer rod when the instrument is held obliquely.

For a transfer rod made of acrylic fibers or of polyester, or of a polyethylene type open-pore sintered microporous material, the capillary element is made of a polyethylene or polypropylene type open-pore sintered microporous material.

The capillary element may also act as a gauge or indicator for the level of liquid ink in the reservoir, providing the density of the element is less than that of the liquid ink. For this purpose, it is necessary for the reservoir to be transparent or translucent at least in part and for the capillary element to have distinctive marking, contrasting it visually with the ink.

Given that the capillary element is constantly in contact with the liquid ink, the ink spreads throughout the capillary volume of the element, and as a result the element has the same color as the ink. In order to enable the user to distinguish it by eye, so that the capillary element can act as a gauge, it must include distinctive marking.

The marking can be the result of having zones from which ink is absent. For example, if the capillary element is made of a sintered material having open pores, then said zones can be made out of the same sintered material but having pores that are closed. The ink cannot penetrate into the closed-pore zones, so said zones retain their original color while the open-pore zones take on the color of the ink.

BRIEF DESCRIPTION OF THE DRAWINGS

The present invention will be better understood on reading the following description of an embodiment of a liquid ink writing instrument having a transfer rod and in which the reservoir includes a system for preventing loss of priming by means of a floating capillary element capable of sliding along the transfer rod, as shown in the accompanying drawings, in which.

MORE DETAILED DESCRIPTION

Figure 1:
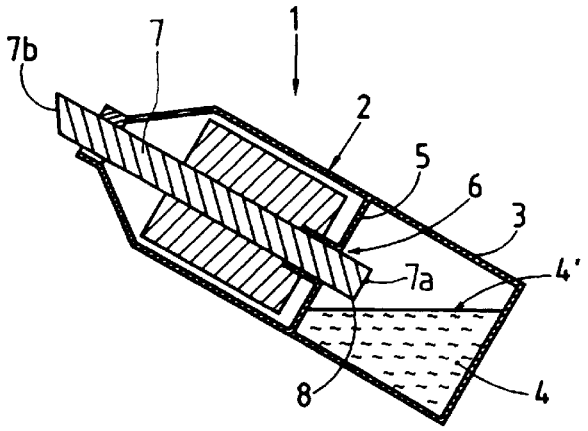
FIG.1 PRIOR ART
FIGS. 1 and 2 are section views of a known writing instrument in oblique writing positions, with the tip shown high in FIG. 1 and low in FIG. 2.
Figure 2:
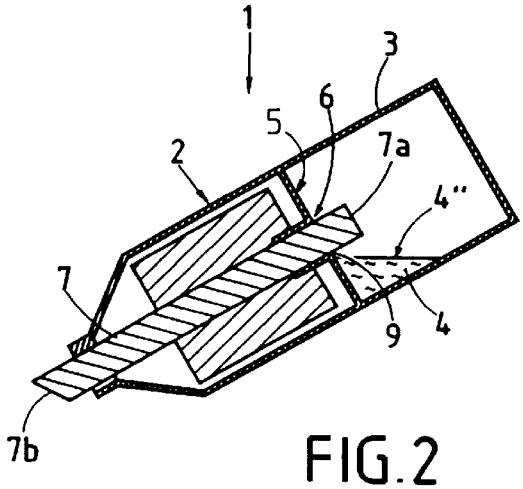
FIG.2 PRIOR ART

FIGS. 1 and 2 show a writing instrument 1 whose structure is already known from document EP 0 516 538. The writing instrument 1 is constituted by a substantially cylindrical hollow body 2 whose rear portion 3 acts as a reservoir 3 for liquid ink 4. The reservoir 3 is closed by an inside partition 5 including a central orifice 6. The writing instrument 1 is also constituted by a transfer rod 7 whose rear end 7*a* penetrates into the reservoir 3 via the central orifice 6 and whose front end 7*b* projects outside the body 2 to form the writing tip of the instrument. The rear end 7*a* of the transfer rod 7 is engaged with a small amount of force in the central orifice 6 of the internal partition 5 so as to ensure that the reservoir 3 is sealed, but without crushing said end 7*a* so as to allow ink and air to travel along the rod 7. The transfer rod 7 is made of a material suitable for transferring ink by capillarity. It may be a felt made of acrylic fibers or of compacted polyester.

Initially, when the writing instrument is new, the liquid ink 4 fills the reservoir 3 completely or nearly completely. Under such circumstances, regardless of the position taken up by the writing instrument, liquid ink 4 in the reservoir 3 comes into contact with the rear end 7*a* and migrates by capillarity along the transfer rod 7 until it reaches the front end 7*b* that forms the writing tip. However, use of the writing instrument causes the volume of ink contained in the reservoir 3 to be reduced, and thus gives rise to an ever increasing risk of ink no longer coming into contact with the end 7*a* of the transfer rod 7, in which case the transfer rod 7 will lose priming.

This loss of priming of the transfer rod 7 causes writing to cease because ink no longer reaches the writing tip, even though liquid ink is still present in the reservoir 3.

By way of non-exhaustive example, FIGS. 1 and 2 show two cases that can give rise to the instrument 1 losing priming.

In FIG. 1, the instrument 1 is oblique with its tip high. This happens in particular when the instrument 1 is used on a board or other writing medium that is substantially vertical. The remaining quantity of liquid ink 4 is insufficient for the surface 4' of the ink 4 in the reservoir 3 to reach the portion 8 of the rear end 7*a* that is closest to the ink 4. Once the ink already contained in the transfer rod 7 has been used up, the instrument 1 can no longer write because it has lost priming. It is then necessary to put the rear end 7*a* of the transfer rod back into contact with the ink 4 and to wait for the ink to diffuse again along the transfer rod from its rear end 7*a* all the way to its front end or tip 7*b*.

The same applies in the circumstances shown in FIG. 2 where the instrument 1 is oblique, but this time with its tip low. This is conventional use on a medium that is substantially horizontal. In this case, the quantity of ink 4 that remains in the reservoir 3 is very small, so its level 4" does not reach the portion 9 of the rear end 7*a* of the transfer rod coinciding with where said rear end 7*a* is engaged in the central orifice 6 of the internal partition 5. Given that loss of priming takes place when the amount of ink remaining is rather low, it is generally accepted that the instrument 1 is discarded before all of the ink 4 has been used up.

The examples given in FIGS. 1 and 2 are not limiting. Loss of priming of the transfer rod 7 can also be observed when the writing instrument is horizontal and the level of ink is insufficient to come into contact with the transfer rod. In addition, loss of priming need not take place solely while the instrument is being used, but can also take place while the writing instrument is being stored. Under such circumstances, prolonged storage of a writing instrument that makes use of a pigment-based ink and in which the writing tip is no longer primed, gives rise to the solvent(s) of the ink contained in the transfer rod evaporating while leaving the pigments of the ink imprisoned in the capillary network of the transfer rod, thus giving rise to harmful clogging of the capillary network. This can result in the transfer rod 7 being made permanently ineffective, so there is no way in which the instrument can be used again.

The present invention seeks to propose a writing instrument of the type shown in FIGS. 1 and 2 that is fitted with a system for preventing loss of priming and which thereby serves to mitigate the above-mentioned drawbacks. The system of the invention for preventing loss of priming, an embodiment of which is described below, enables the transfer rod to be fed continuously with liquid ink regardless of the way in which the instrument is used or stored after use, and also makes it possible to actually make use of substantially all of the ink contained in the reservoir.

In order to be suitable for fitting with the system of the invention for preventing loss of priming, the instrument 10 (FIG. 3) is provided with a transfer rod 11 which extends over the full height of the reservoir 12, its end 11*a* extending to the far end 12*a* of the reservoir. The system proper for preventing loss of priming consists in a capillary element 13 which is made of a material that allows ink to diffuse by capillarity like it does in the transfer rod 11. This capillary element 13 is produced with an orifice 14 shaped to allow the transfer rod 11 to pass therethrough. In the specific case of a transfer rod 11 that is of circular section, the orifice 14 is also circular in shape, having a diameter that is slightly greater than that of the transfer rod 11.

Also, the outermost edge 13*a* of the capillary element 13 is of a shape similar to that of the inside wall 12*b* of the reservoir 12, but slightly smaller.

Figure 3:
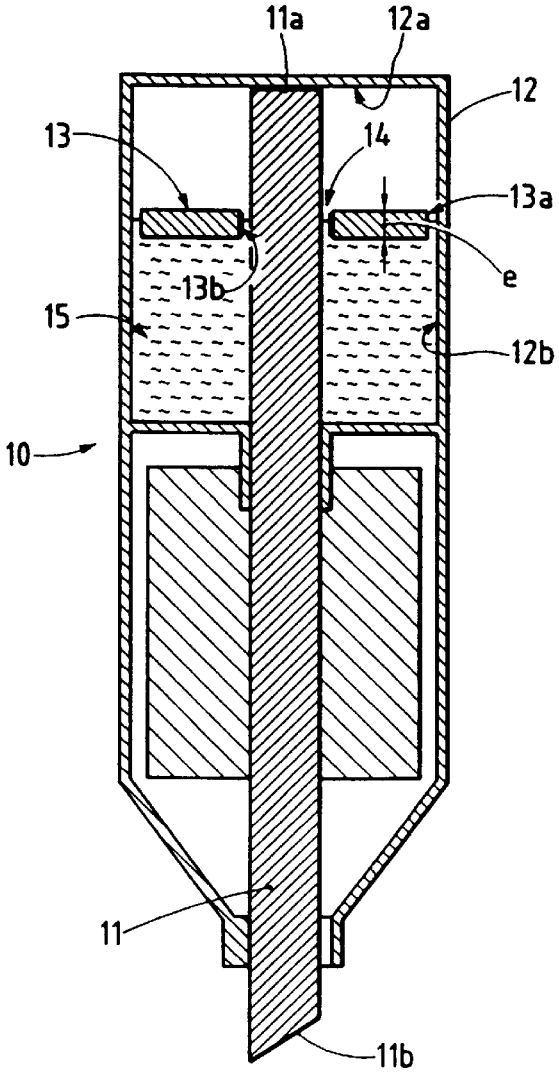
FIG. 3 is diagrammatic longitudinal section through a writing instrument fitted with the system for preventing loss of priming.

In the example shown in FIG. 3, the capillary element 13 is cylindrical in shape, of small thickness e, and pierced axially so as to form the orifice 14. When put into place around the transfer rod 11, inside the reservoir 12, the element 13 can slide naturally along the rod 11, because of the clearance that exists both between its outside edge 13*a* and the inside wall 12*b* of the reservoir 12, and between its inside edge 13*b* and the transfer rod 11.

When the capillary element 13 is also used as a level indicator, it is necessary for the capillary material constituting the element 13 to be of density lower than that of the liquid ink 15. Under such circumstances, as shown in FIG. 3, the capillary element 13 floats on the surface of the ink 15 contained in the reservoir 12. Naturally, it is also possible within the ambit of the invention to envisage using an element 13 of density greater than that of the ink used, such that the element 13 is dipped completely in the liquid ink 4. Under such circumstances, the element 13 can no longer act to indicate ink level.

When the instrument 10 is in the state shown in FIG. 3, the capillary element 13 has no function since the ink 15 is directly in contact with the transfer rod 11 and can therefore feed said transfer rod all the way to its front end 11*b* acting as a writing tip. The only use of the element 13 under such circumstances is to act as a level indicator, as explained below.

Figure 4:
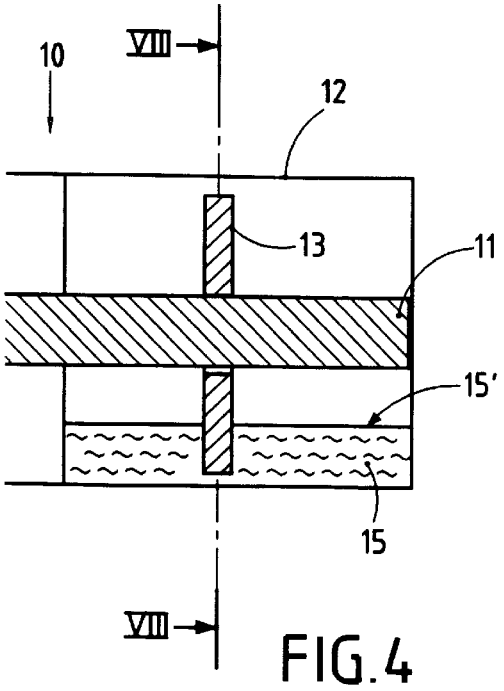
FIGS. 4 and 5 are diagrammatic and fragmentary longitudinal section views of the FIG. 3 instrument in a horizontal position in FIG. 4 and in a tip-low sloping position in FIG. 5.
Figure 5:
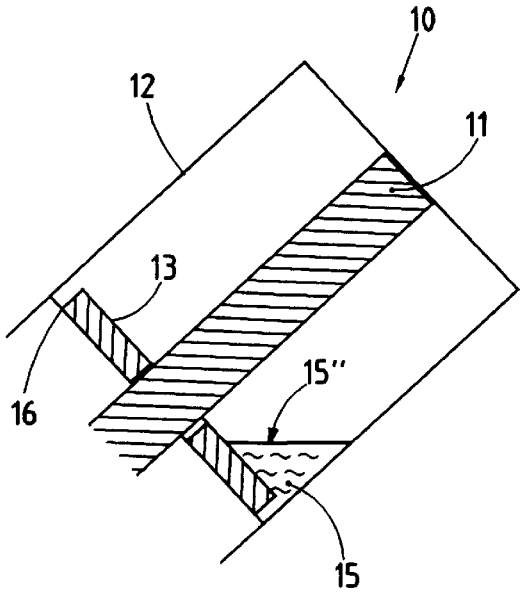
Figure 6:
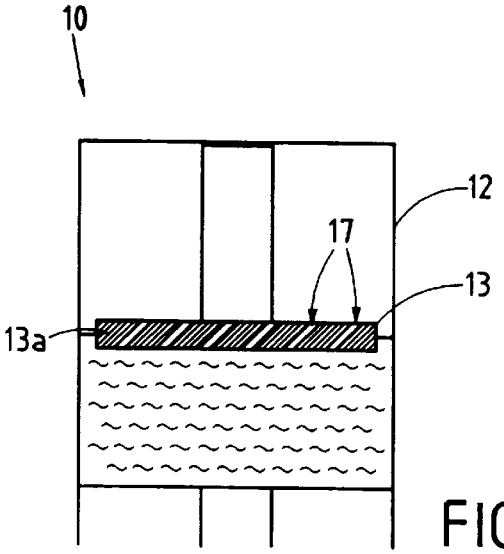
FIG. 6 is a fragmentary diagrammatic side view of the FIG. 3 instrument, with the system for preventing loss of priming acting as an ink-level gauge.

FIGS. 4 and 5 show two cases of use in which the capillary element 13 is performing its function of preventing loss of priming.

The quantity of ink 15 remaining in the reservoir 12 of the writing instrument 10 is such that when in the horizontal position, the level 15' of the ink 15 in the reservoir 12 no longer reaches the transfer rod 11 (FIG. 4).

Figure 8:
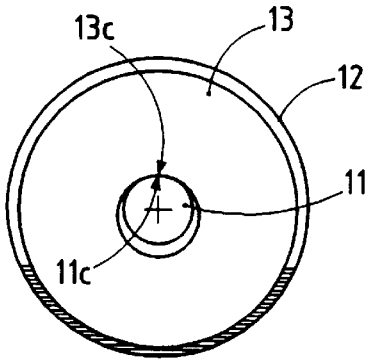
FIG. 8 is a cross-section view of the FIG. 4 instrument on axis VIII—VIII.

When the instrument 10 is in this horizontal position, the capillary element 13 extends transversely to said transfer rod 11 and is suspended vertically therefrom. More precisely, a zone 13*c* of the inside edge 13*b* of the capillary element 13 is in contact with a zone 11c of the transfer rod 11, as shown in FIG. 8. This figure shows more clearly the differences in diameter that correspond to the capillary element 13 being larger in diameter than the transfer rod 11 (inside edge 13*b*) and smaller in diameter than the reservoir 12 (outside edge 13*a*).

In an embodiment, the transfer rod 11 has a diameter of 3.5 mm, the capillary element 13 has an orifice 14 with a diameter of 4.5 mm, thereby leaving clearance of 1 mm, while the reservoir 12 has an inside diameter of 14 mm and the capillary element 13 has an outside diameter of 13 mm, likewise corresponding to clearance of 1 mm.

Loss of priming is prevented as follows. The bottom portion of the capillary element 13 dips into the liquid ink 15 which migrates throughout the entire capillary network of the element 13. The ink contained in the capillary network can itself migrate into the transfer rod 11 via the zones 13*c* and 11*c* which are in contact between the capillary element 13 and the transfer rod 11. Naturally it is necessary for the capillary network of the element 13 to have sufficient capillarity to enable such diffusion to take place in that zone. It should also be observed that unlike that which is shown in FIGS. 4 and 8, it would also be possible in the ambit of the invention to use an element 13 of density that is so small relative to that of the ink as to enable the element 13 to be supported solely by the liquid ink, in which case the contacting zones 11*c* and 13*c* would be situated respectively on the underside of the transfer rod 11 and on the bottom of the inside edge of the element 13.

For a transfer rod 11 made of acrylic fibers or of polyester, or optionally of a sintered microporous material having open pores, the capillary element 13 is preferably made of a sintered microporous material having open pores. More particularly, the porosity of the capillary element 13 should lie in the range 30% to 70%. Preferably, it also comprises polyethylene or possibly polypropylene material, thereby reducing the coefficient of friction between the element 13 and the transfer rod, and thus making the element 13 slide more easily.

Advantageously, the hydrophilic nature of the capillary element 13 relative to the ink used is further improved in a first variant by adding an agent for reducing the surface tension of the ink. More particularly, specific agents that could be used include a non-ionic surfactant such as Nonylphenol-ethoxylate sold by Union Carbide under the trademark TERGITOL® or such as a fatty amide sold by SEPPIC under the trademark ORAMIDE®, or indeed a polysiloxane sold by BYK CHIMIE under the trademark BYK®.

The quantity of agent used naturally depends on the intrinsic surface tension of the ink used and on the type of material constituting the capillary element. By way purely of indication, given the usual surface tension of inks commonly in use at present, when the capillary element 13 is made of an open-pored sintered microporous polyethylene or polypropylene material, then about 1% by volume of agent is added relative to the total volume of ink.

In a second variant that can be combined with the above-mentioned first variant, the hydrophilic nature of the capillary element 13 relative to the ink used is improved by subjecting the material constituting the element 13 to a treatment enabling the surface energy of the material to be increased. This comprises more particularly oxidizing plasma treatment or indeed treatment by depositing a surface active agent on the capillary element.

In the example shown in FIG. 5, there remains very little liquid ink 15 in the reservoir 12. When the instrument 10 is used obliquely with its tip low, as shown, the level 15" of the ink 15 does not reach the transfer rod 11. The capillary element 13 slides down along the transfer rod 11 until it reaches the internal partition 16 closing the front end of the reservoir 12, such that its bottom portion dips into the liquid ink 15, thereby enabling it to diffuse into the capillary network of the element 13 and all the way to the transfer rod 11.

Figure 7:
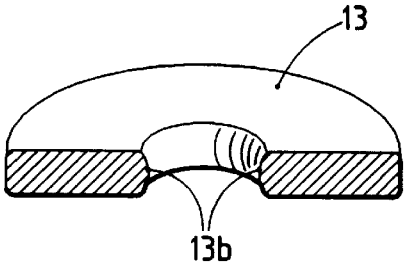
FIG. 7 is a fragmentary diagrammatic view in perspective of the capillary element having a rounded inside edge.

In order to enable sliding to take place along the transfer rod 11, without any risk of the capillary element 13 jamming at an intermediate level which would prevent the capillary element from coming into contact with the liquid ink, it is preferable for the inside edge 13*b* of the element 13 to be rounded rather than sharp, as shown in FIG. 7. In another variant, it is also possible for the outside edge 13*a* of the element 13 to be rounded likewise.

It is also desirable for the weight of the capillary element 13 to be sufficient to cause it to slide along the transfer rod 11 while the instrument 10 is in use in a sloping position, and for this to occur even at small angles of inclination. For this purpose, the thickness e of the capillary element preferably lies in the range 2 mm to 4 mm.

When the capillary element 13 is also used as a level indicator, it is important firstly for the reservoir 12 to be made of a material which is transparent or at least translucent over at least one of the faces of the reservoir extending parallel to the transfer rod 11. By way of example, it is possible to provide a window occupying the full height of the reservoir 12 along one of the faces thereof but occupying a limited width. It is also necessary for the material from which the capillary element 13 is made to be less dense than the liquid ink 15. This can be achieved in particular by using an open-pore sintered porous material based on polyethylene or on polypropylene.

In addition, in order to enable the user to see the level of the capillary element 13, the outside edge 13*a* thereof can be provided, for example, with distinctive marking, suitable for being seen by the user through the wall of the reservoir 12.

This distinctive marking makes it possible to distinguish between liquid ink and the ink impregnating the capillary network of the element 13. One such distinctive mark can be constituted by stripes 17 that can be obtained, for example, by using the same material on the outside edge 13*a* as the material constituting the bulk of the capillary element 13, but by ensuring that its pores are closed instead of being open. With a sintered microporous material, stripes can thus be obtained by locally overheating the microbeads in the sintering mold so that in the corresponding zones the microbeads are compacted without forming a capillary network. In this way, the ink does not penetrate into the closed-pore zones where it does penetrate into the open-pore zones. The stripe-forming open-pore zones 17 can be seen on the outside edge 13*a* of the capillary element 13.

Figure 9:
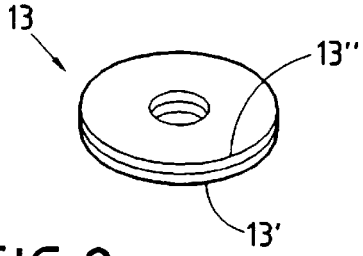
FIG. 9 shows a capillary element made up of two separate elements serving respectively for the purpose of preventing loss of priming and for the purpose of providing visible marking.

In another variant shown in FIG. 9, the capillary element 13 may be constituted by two distinct superposed elements, a capillary first element 13' that performs the function of preventing loss of priming, and a non-capillary second element 13" that acts as a visible marker. By way of example, the non-capillary element 13" is constituted by a pellet made of hydrophobic material, and the two elements 13' and 13" can be assembled together by any appropriate means, and in particular by heat sealing or by adhesive.

The present invention is not limited to the embodiment given by way of non-exhaustive example. In particular, the transfer rod 11, the capillary element 13, and the reservoir 12 may all have shapes other than those described above. It suffices firstly for the capillary element to be able to slide freely between the end wall of the reservoir and the internal partition closing the front thereof, and secondly for the capillary element to be capable of transferring ink into the transfer rod in the zones of contact. In particular, the zones of contact can be increased by using a transfer rod, and thus an orifice for the capillary element, that are polygonal in section instead of being circular in section.

We claim:

1. A writing instrument, comprising:

a writing tip;

a reservoir containing a liquid ink, said reservoir having a first end and a second end;

a capillary transfer rod having an outer diameter, said capillary transfer rod extending from said first end to said second end of said reservoir and constructed and arranged to transfer said liquid ink from said reservoir to said writing tip;

a capillary element including an orifice, said orifice having an inner diameter greater than the outer diameter of said capillary transfer rod, said capillary element being slidably mounted around said capillary transfer rod so as to move freely in said reservoir; and an outside edge of said capillary element coming into the immediate vicinity of an inside wall of the reservoir in such a manner that said capillary element comes substantially flush with an inside wall of said reservoir as it slides along the transfer rod.

2. An instrument according to claim 1, wherein said orifice of said capillary element is about 0.2 mm to about 0.8 mm greater in size than the outer diameter of said capillary transfer rod.

3. An instrument according to claim 1, wherein said capillary transfer rod has a cross-sectional diameter of about 3.5 mm, and said orifice of said capillary element has a diameter of about 4.5 mm.

4. An instrument according to claim 1, wherein said reservoir is cylindrical in shape, having an inside diameter of about 14 mm, and said capillary element is circular in shape, having an outside diameter of about 13 mm.

5. An instrument according to claim 1, wherein said capillary element has a thickness in the range of 2 mm to 4 mm.

6. An instrument according to claim 1, wherein an inside edge of said capillary element around said orifice is rounded.

7. An instrument according to claim 1, wherein the transfer rod is comprised of acrylic fibers or of polyester, or of a poly-ethylene type open-pore sintered microporous material, and the capillary element is comprised of a polyethylene or polypropylene type open-pore sintered microporous material.

8. An instrument according to claim 1, wherein the ink further comprises an agent for reducing a surface tension of the ink.

9. A writing instrument according to claim 8, wherein said agent is a non-ionic surface-active agent.

10. An instrument according to claim 1, wherein to make the capillary element more hydrophilic relative to the ink used, the material of the capillary element is subjected to treatment enabling its surface energy to be increased, and more particularly to oxidizing plasma treatment or to deposition of a surface-active agent.

11. A writing instrument according to claim 1, wherein said reservoir is transparent or translucent, at least in part, and said capillary element has a density that is less than that of the liquid ink, and has a marking that is visually distinct from the ink.

12. An instrument according to claim 11, wherein said capillary element comprises an open-pore sintered material, and said marking corresponds to zones made of the same sintered material but having closed pores.

13. An instrument according to claim 11, wherein said capillary element is comprised of two separate superposed elements, a capillary first element for preventing loss of priming and a non-capillary second element acting as a visible marker.

* * * * *